United States Patent [19]

Lincke et al.

[11] Patent Number: 4,505,306

[45] Date of Patent: Mar. 19, 1985

[54] AIR DISTRIBUTOR AND CONTROL UNIT FOR A JET INSERTION WEAVING MACHINE

[75] Inventors: Paul Lincke, Zell, Switzerland; Oswin Kohlhaas, Herzogenrath-Kohlscheid; Adnan Wahhoud, Aachen, both of Fed. Rep. of Germany

[73] Assignee: Sulzer Brothers Limited, Winterthur, Switzerland

[21] Appl. No.: 439,787

[22] Filed: Nov. 8, 1982

[30] Foreign Application Priority Data

Nov. 25, 1981 [EP] European Pat. Off. ..... 81810468.9

[51] Int. Cl.[3] ..... D03D 47/30

[52] U.S. Cl. ..... 139/435; 137/624.18

[58] Field of Search ..... 139/435; 226/95, 97; 239/407, 410, 414; 137/624.18, 624.2

[56] References Cited

U.S. PATENT DOCUMENTS

| | | | |
|---|---|---|---|
| 4;245,677 | 1/1981 | Suzuki | 139/435 |
| 4,303,106 | 12/1981 | Yoshida et al. | 139/435 |
| 4,450,875 | 5/1984 | Simson et al. | 139/435 |

FOREIGN PATENT DOCUMENTS

| | | | |
|---|---|---|---|
| WO82/02411 | 7/1982 | PCT Int'l Appl. | 139/435 |

*Primary Examiner*—James Kee Chi

*Attorney, Agent, or Firm*—Kenyon & Kenyon

[57] ABSTRACT

The air distributor and control unit contains a stator with an outlet port and a rotor which is rotatably mounted within the stator with an opening to permit a flow of air to the outlet port. A control element is provided between the rotor and stator to control the supply of medium from a pressure chamber to the outlet port. The control element may be in the form of interfitting shell type members which can be adjusted to change the beginning, end and/or duration of blowing for a given nozzle.

17 Claims, 12 Drawing Figures

AIR DISTRIBUTOR AND CONTROL UNIT FOR A JET INSERTION WEAVING MACHINE

This invention relates to an air distributor and control unit for a jet insertion weaving machine. More particularly, this invention relates to an air distributor and control unit for the nozzles of an air insertion weaving machine.

As is known, various types of jet insertion weaving machines have been developed over the years. In many cases, these machines employ either air or a fluid such as water for the insertion of a weft yarn into a shed of warp yarns. In some cases, use is made of a main nozzle for directing a weft yarn into a shed and a plurality of auxiliary nozzles arranged along the weft insertion path within the shed to control the flight of the weft thread. In such cases, various control devices have been provided for controlling the air flow to these nozzles. For example, as described in German O.S. Nos. 21 45 256 and 26 42 754, such control devices frequently are constructed of a stator and a rotor which distribute the weft insertion medium, for example, over the nozzles.

Conventionally, the rotor of the control device runs directly on the stator, that is, with contact. In addition, the stator is provided with various ports which can be connected to control lines for the various nozzles while the rotor is provided with a bore which passes in the rhythm of the work cycle successively over one or more of the ports of the stator. If an adjustment in the beginning and/or end, and possibly the duration, of the blowing time of the individual nozzles is desired it has heretofore been necessary to attach the rotor in a different angled position or to replace the rotor with another rotor with a wider or narrower distributing bore. Alternatively, the stator can be replaced by another stator with different sized ports. In either case, an adjustment or replacement of parts becomes expensive, particularly during operation if such adjustment or replacexent can be performed at all during operation.

Accordingly, it is an object of the invention to provide an air distributor and control device of relatively simple design which can be readily adjusted.

It is another object of the invention to provide a simple means for adjusting the air flows to weft insertion nozzles in a weaving machine.

It is another object of the invention to provide an air distributor and control unit which can be readily adjusted from time to time.

Briefly, the invention provides an air distributor and control unit for at least one nozzle of a jet insertion weaving machine. The unit includes a stator having one or more ports for communication with the nozzle, a chamber to receive a pressurized flowable medium such as air, a rotor which is rotatably mounted within the stator and which has an opening to periodically communicate the chamber with the respective ports and means between the rotor and stator for controlling the supply of xedium from the chamber through the respective ports.

The means which is located between the rotor and stator is adjustably mounted in order to adjust the time of communication between the chamber containing the pressurized medium and the port or ports in the stator during rotation of the rotor. This permits the beginning and/or end of the blowing air at the individual nozzles and also the period during which the nozzles blow to be controlled or adjusted in a simple manner.

The air distributor and control unit can be adjusted, for example when a different weft material such as one of higher or lower weight or one having a different surface structure and "handy" is to be inserted into the shed of a weaving machine. In these cases, the different weft materials may have a lower or higher rate of insertion. In addition, from the practical experience of the weaving operation, an operator may need to occassionally adjust the beginning and/or end of blowing as well as the duration of the blowing action through the various nozzles. The air distributor and control unit permits the weaving operation to be optimized, particularly with respect to air consumption.

In one embodiment, where the stator and rotor are made of parts which are in the form of concentrically disposed cylinders, the means between the rotor and stator is in the form of at least one shell type member having comb-like projections aligned with the ports in the stator. Upon adjusting the member circumferentially relative to the stator, the duration and time of communication between the pressurized chamber and ports in the stator can be varied.

In another embodiment, where the rotor and stator concentrically disposed, the means for controlling the supply of medium is in the form of a bushing which has a plurality of circumferentially disposed cut-outs of disparate circumferential size which are aligned with a port in the stator.

In still another embodiment, the rotor is formed as a disc which faces the pressurized chamber while the control means is in the form of a disc-shaped control element adjustably mounted between the disc and a port in the stator. In this case, the control element has a plurality of circumferentially disposed cut-outs of disparate circumferential size which are aligned with a port in the stator. A suitable means is also provided for rotating the disc from time to time relative to the port in the stator so as to present a different cut-out to the port.

In still another embodiment, wherein the rotor includes a disc facing the pressurized chamber, the means for controlling the supply of medium is in the form of a segmented ring-shaped control element which is adjustably mounted in the stator between the disc and a port in the stator. In this case, the control element has an end aligned with the port for circumferential movexent relative to the port. Again, any suitable means may be provided for controlling the movement of the element from time to time.

These and other objects and advantages of the invention will become more apparent from the following detailed description taken in conjunction with the accompanying drawings wherein.

Figure 1:
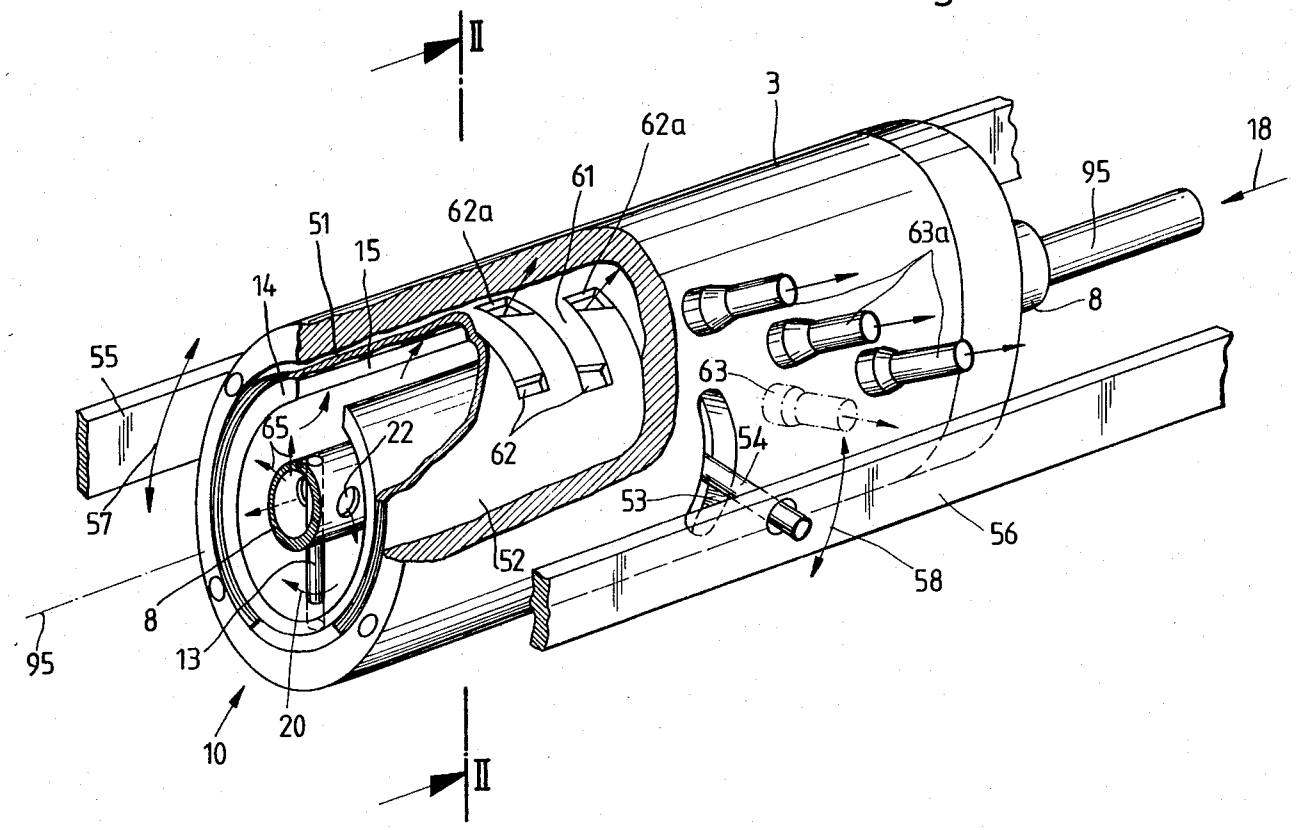
FIG. 1 illustrates a part perspective view of an air distributor and control unit constructed in accordance with the invention.
Figure 2:
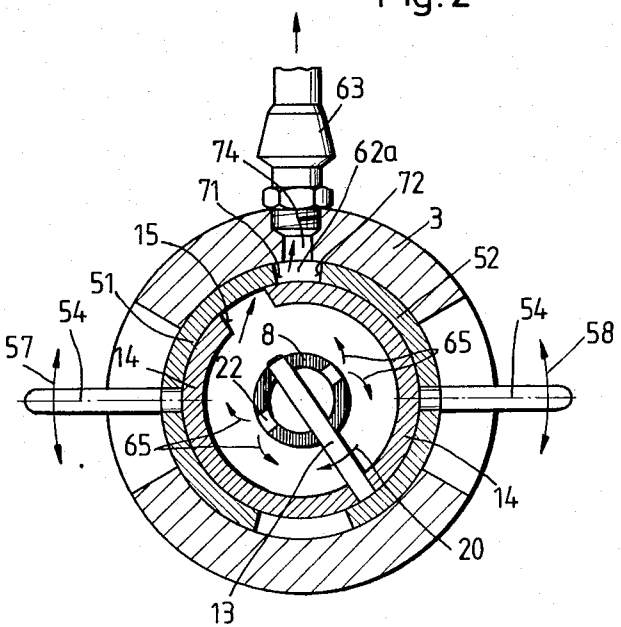
FIG. 2 illustrates a view taken on line II—II of FIG. 1.

Referring to FIG. 1, the air distributor and control unit 10 is adapted to control the flow of air to a plurality of nozzles used in an air insertion weaving machine (not shown) for insertion of a weft thread into a shed of warp threads (not shown). The unit 10 includes a stator in the form of a fixed pressure vessel 3, for example as described in U.S. Pat. No. 4,450,875. The vessel 3 serves to define a chamber for receiving a pressurized flowable medium such as air. In addition, the unit 10 includes a rotor which is rotatably mounted within the vessel 3. As shown in FIGS. 1 and 2, the rotor is constructed of a hollow shaft 8, a plurality of tappets 13 which are secured to and transversely along the shaft 8 and a control slide 14 which is also secured to the tappets 13. The hollow shaft 8 is supplied with compressed air from a suitable source as indicated by the arrow 18 in FIG. 1. In addition, the shaft 8 has a plurality of bores 22 through which the air is exhausted as indicated by the arrows 65 in FIG. 2. The control slide 14 is carried along with the shaft 8 in the direction indicated by the arrow 20 and has an opening or slot 15 through which the air may be expelled.

The pressure vessel 3 is provided with a plurality of ports 74 (see FIG. 3) to which connections 63 are made for supplying air to the nozzles (not shown) for the weft insertion. As indicated in FIG. 3, the ports 74 may be disposed helically about the pressure vessel 3 rather than longitudinally in a straight line.

Referring to FIGS. 1 and 2, means are provided between the control slide 14 and the pressure vessel 3 for controlling the supply of air from the pressurized chamber through the respective ports 74. As indicated, this means is in the form of a pair of shell type members 51, 52 which are adapted to the cylindrical form of the slide 14 and which extend over approximately 160°. The pressure vessel 3 is provided with a pair of diametrically disposed elongated cut-outs 53 through which pins 54 project. As indicated in FIG. 2, each pin 54 is secured to a respective mexber 51, 52 and serves as a means adjusting the member 51, 52 circumferentially relative to the pressure vessel 3. In addition, as shown in FIG. 1, actuating rods 55, 56 are connected with the pins 54 and are movable in the directions indicated by the arrows 57, 58. These rods 55, 56 may extend over several units 10 which may be present on a weaving machine.

Figure 3:
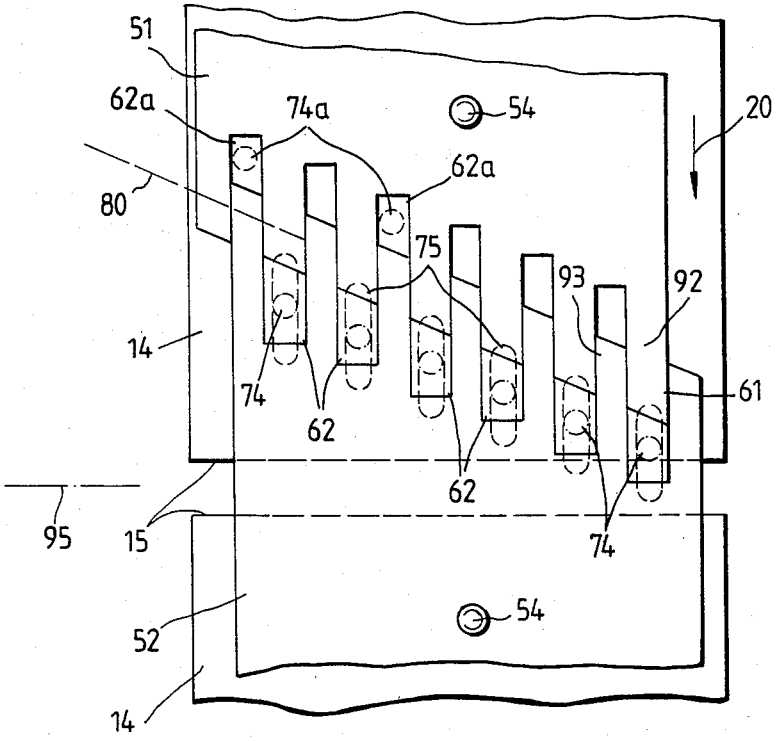
FIG. 3 illustrates a development of the various parts of the distributor and control unit of FIG. 1.

Referring to FIGS. 1 and 3, the members 51, 52 are disposed in diaxetrically disposed relation about the control slide 14 and have interfitting projections 61. These projections 61 engage in comb-like fashion and, thus, form slots 62 of adjustable size. These slots 62 are each aligned with a respective port 74 in the pressure vessel 3.

During operation, the rotor 8, 13, 14 rotates in the rhythm of the weaving machine (not shown). During this time, compressed air is supplied via a supply line to the hollow shaft 8 and issues via the bores 22 into the interior of the pressure vessel as indicated by the arrows 65. During this rotation, the slot 15 of the control slide 14 is successively guided over the slots 62 defined by the members 51, 52 so that the nozzle connections 63 are successively supplied with air, for example in accordance with the insertion speed of the weft thread or in accordance with the progress of the tip of the weft thread in a shed so as to carry the thread through the entire shed.

In the event that the start of blowing is to be set to an earlier tixe at all the nozzles, the member 51 is adjusted counter-clockwise, as viewed in FIG. 2. In this case, the free edge 71 of the member 51 is displaced to the left, as viewed, that the start of blowing can occur at an earlier time. In this respect, the movement of the member 51 permits the slot 15 in the control slot 14 to permit an earlier communication between the pressurized chamber within the vessel 3 and the respective ports 74.

If the member 52 is not adjusted at the same time, the edge 72 of the element 52 remains at the location indicated in FIG. 2. Hence, the end of blowing of the respective nozzle remains at the same point in time. However, the duration of blowing through the nozzle is lengthened.

If the blowing period through the nozzle and the related port 74 is to be shortened, the edges 71, 72 of both members 51, 52 are shifted toward each other. For example, element 51 is turned clockwise while element 52 is turned counter clockwise as view in FIG. 2. In the event that only the end of blowing is to be set to a later time, the edge 72 of the member 52 is displaced clockwise.

As noted above, the movements of the respective elements 51, 52 are caused via the pins 54 and actuating rods 55, 56.

Figure 4:
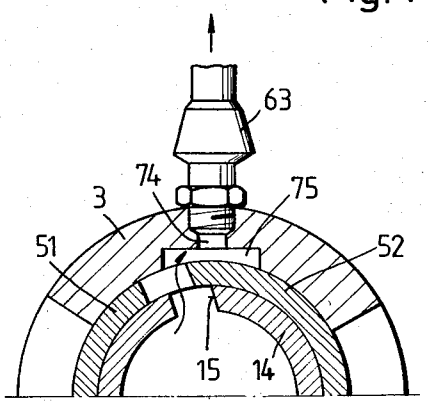
FIG. 4 illustrates a cross-sectional view similar to FIG. 2 of a modified stator according to the invention.

Referring to FIG. 4, instead of using ports 74 of only circular shape, the vessel 3 may be provided with elongated manifolds 75 on the interior surface in communication with the respective ports 74. Such manifolds 75 may be in the form of oval cut-outs as indicated in dashed lines in FIG. 3 so that the adjustment range of the start of blowing and/or end of blowing as well as the duration of blowing can be increased.

Referring to FIG. 3, additional ports 74*a* may also be provided in the vessel 3 for additional connections 63*a*. As indicated, these ports 74*a* are aligned with slots 62*a* which are formed by the comb-like projections of the two interfitting members 51, 52.

Of note, the projections 92, 93 of the members 51, 52 are disposed on a helical line 80. This helical line 80 may be made steeper or less steep relative to the axis 95 of the unit 10. In addition, the slot 15 of the slide 14 may be more or less helical and need not be parallel to the axis 95. The helical form may also be inclined more relative to the axis 95 than the helical line 80 or the inclination may be less.

Figure 5:
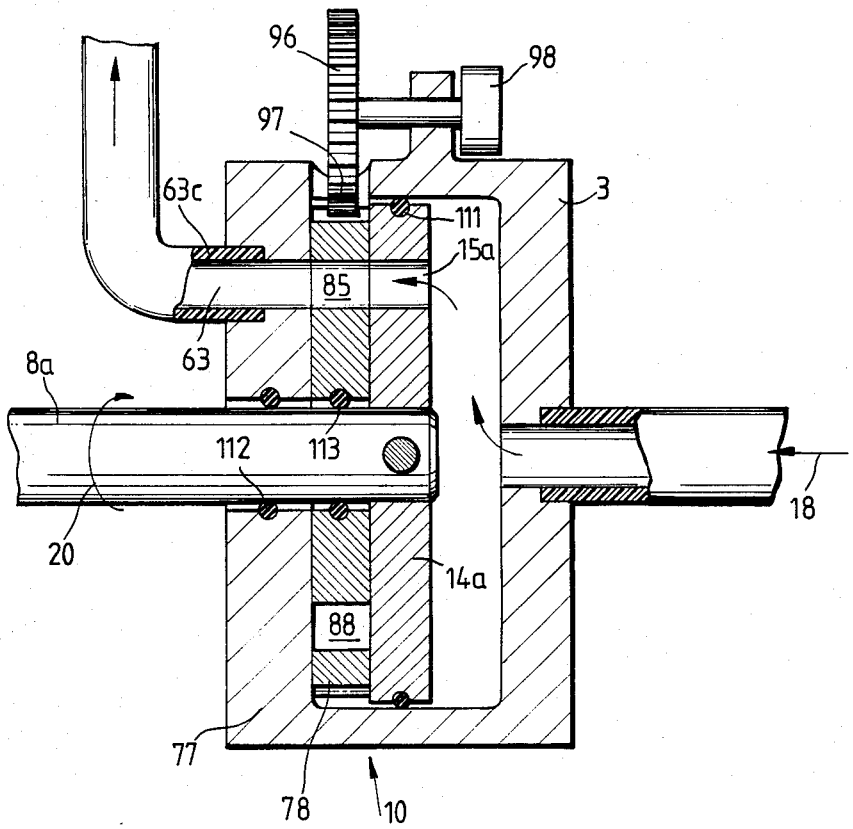
FIG. 5 illustrates a cross-sectional view of a modified air distributor and control unit according to the invention.
Figure 6:
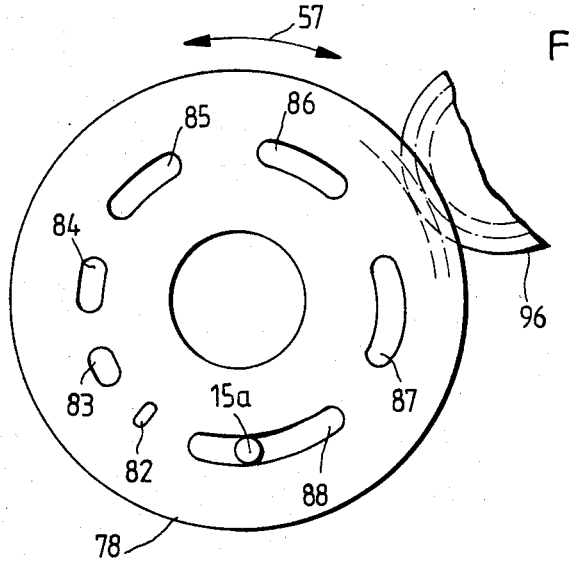
FIG. 6 illustrates a front view of the control element of FIG. 5.

Referring to FIGS. 5 and 6, the air distributor and control unit may be constructed with a stator in the form of a pressure vessel 3 which defines a chamber for receiving a pressurized flow of air via a suitable inlet line as indicated by the arrow 18 (see FIG. 5). In addition, the unit may have a rotor 8*a* which is rotatably mounted within the vessel 3 and which carries a disc 14*a* which faces the pressurized chamber and which has an opening 15*a* to sequentially communicate the chamber with a port in the wall 77 of the vessel 3. As indicated, a suitable connection 63 communicates with the port to deliver air to a nozzle (not shown).

In this embodiment, the means for controlling the supply of medium from the chamber through the port in the wall 77 is in the form of a disc-shaped control element 78 which is adjustably mounted between the disc 14*a* and the port. As indicated in FIG. 6, this control element 78 has a plurality of circumferentially disposed cut-outs 82–88 of disparate circumferential size which are aligned with the port in the wall 77 of the vessel 3. In addition, a suitable means is provided for adjusting the control element 78. As shown in FIG. 5, this latter means is in the form of a gear 96 having teeth 97 which mesh with suitable teeth on the control element 78. The gear 96 is rotatably mounted on the pressure vessel 3 and is driven via a suitable motor, gear or transmission 98.

As shown in FIG. 5, the rotor shaft 8*a* is sealingly disposed within the wall 77 via a seal ring 112 and in the control element 78 via a sealing ring 113. Likewise, the disc 14*a* is sealingly disposed within the pressure vessel 3 via a sealing ring 111.

By turning the control element 79 from time to time to align a different cut-out 82–88 with the port in the pressure vessel wall 77, the beginning or end of a blow as well as the duration of blow can be varied.

Figure 8:
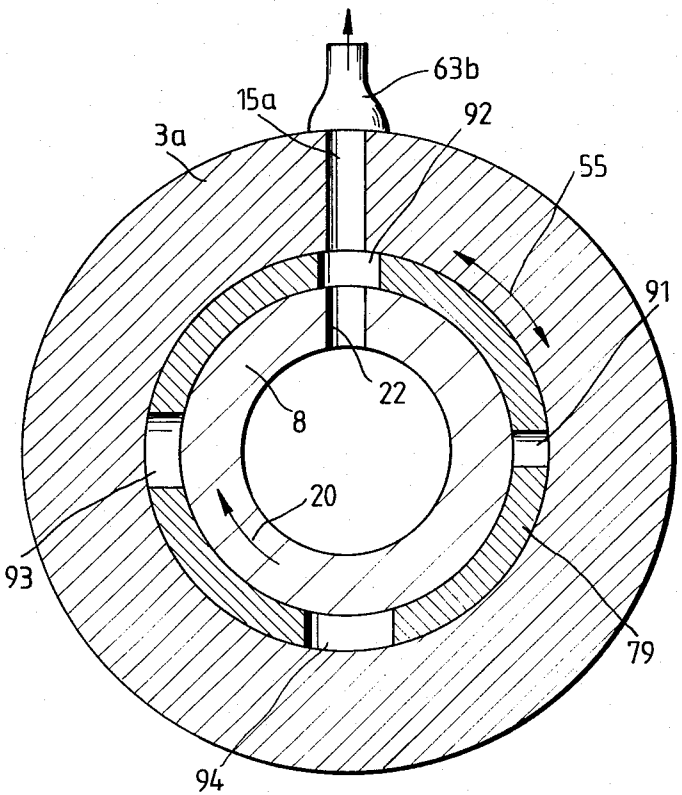
FIG. 8 illustrates a view taken on line VIII—VIII of FIG. 7.
Figure 7:
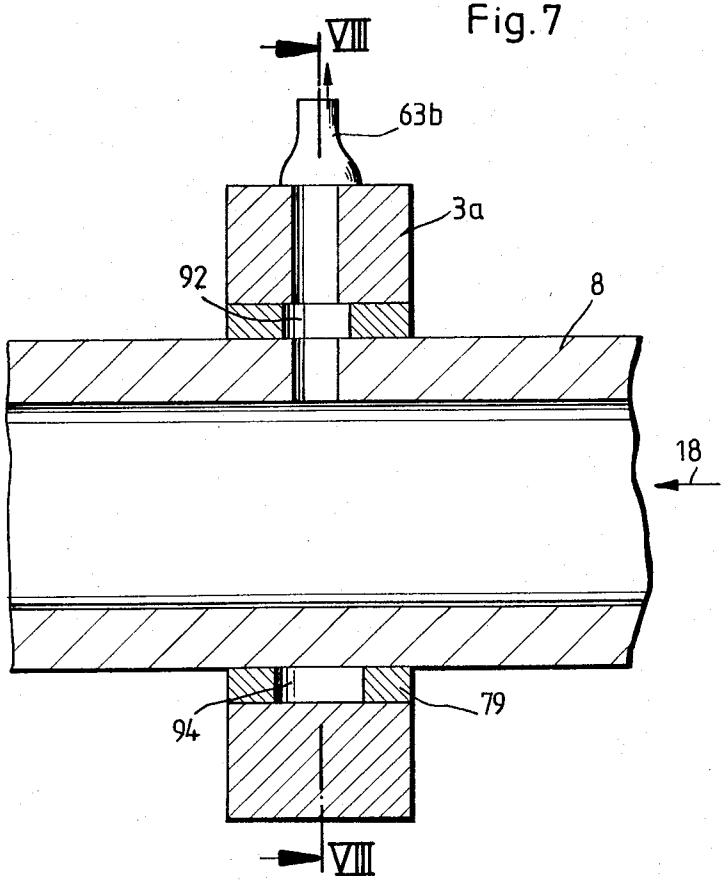
FIG. 7 illustrates a cross-sectional view of a further modified air distributor and control unit according to the invention.

Referring to FIGS. 7 and 8, the air distributor and control unit may have a stator which is simply formed by a ring 3*a* which is formed with a single port 15*a* provided with a connection 63*b*. Likewise, the rotor may include an elongated hollow shaft 8 which defines a pressurized chamber and which has an opening 22 to communicate the chamber with the port 15*a*. In addition, the means for controlling the supply of medium from the chamber to the port 15*a* is in the form of a bushing 79 which is disposed concentrically between the shaft 8 and ring 3*a*. In addition, the bushing is provided with a plurality of circumferentially disposed cut-outs 91–94 of disparate circumferential size which are aligned with the port 15*a* in the ring 3*a*.

During operation, as pressurized air is supplied in the direction indicated by the arrow 18 internally of the shaft 8, the opening 22 periodically communicates the interior of the shaft 8 with the port 15*a* via, for example, cut-out 92. By shifting the bushing 79 slightly in a clockwise or counter clockwise direction, as viewed in FIG. 8, the start and end of a blow can be varied. Further, by shifting a different cut-out in alignment with the port 15*a*, the duration of blow can be varied while also changing the instant at which the blow begins or ends. If, for example, an especially long blowing period is to be obtained, the cut-out 94 is placed in alignxent with the port 15*a*. If a short blowing period is to be obtained, the cut-out 91 is placed in alignment with the port 15*a*. Of note, the cut-outs 91–92 are offset by 90° with respect to each other and have circumferential lengths which differ in the direction of displacement 55.

Figure 10:
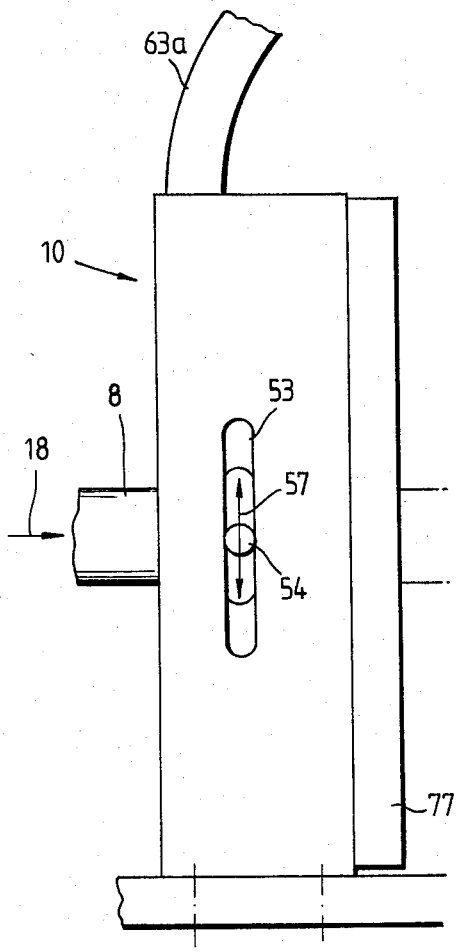
FIG. 10 illustrates a side view of the unit of FIG. 9.
Figure 9:
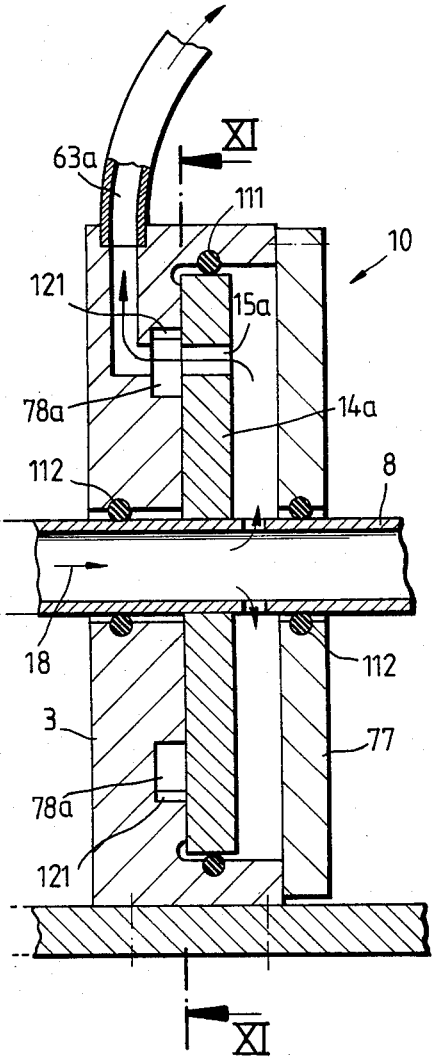
FIG. 9 illustrates a cross-sectional view of a further modified air distributor and control unit according to the invention.
Figure 11:
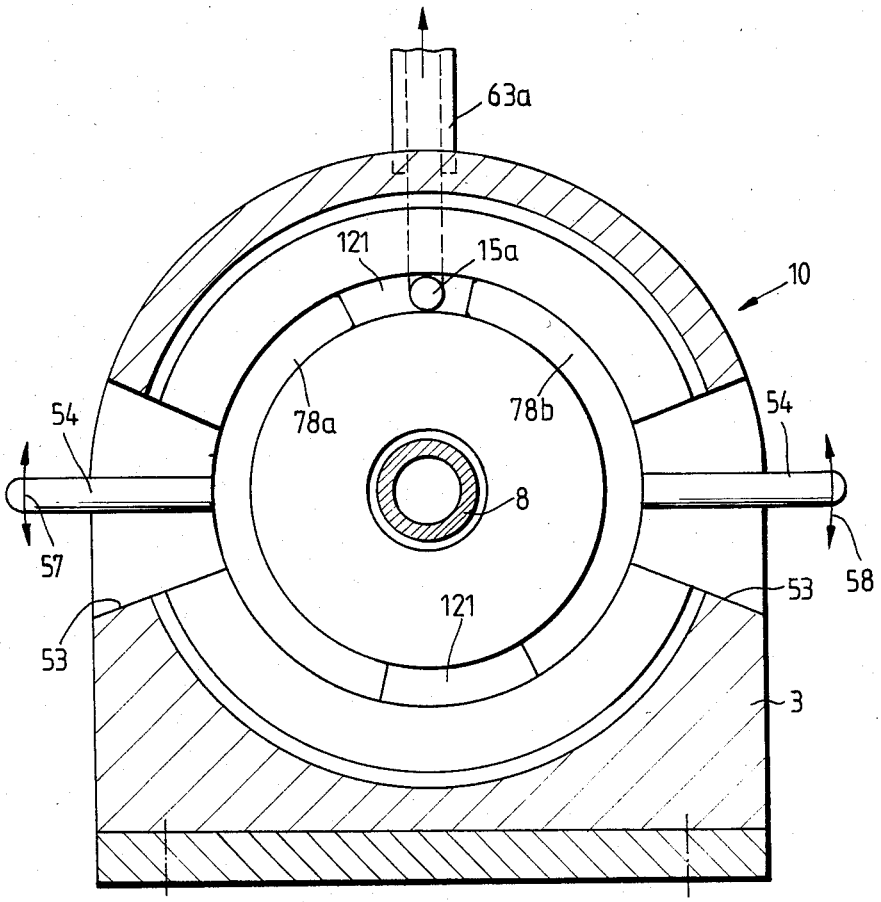
FIG. 11 illustrates a view taken on line XI—XI of FIG. 9.

Referring to FIGS. 9 to 11, wherein like reference characters indicate like parts as above, the air distributor and control unit may have a stator which is formed of two pieces 3, 77 which are secured together as by bolts and mounted on a mounting plate, as by bolts. In addition, the rotor may be in the form of a hollow shaft 8 which passes through the parts 3, 77 of the stator and which are sealed relative thereto by suitable sealing rings 112. As above, the hollow shaft 8 is provided with suitable openings through which pressurized air may pass into a chamber defined by the stator.

In addition, the rotor 8 has a disc 14*a* which is rotatably mounted within the stator and which is sealed thereto via a sealing ring 111. The disc 14*a* has an opening 15*a* to periodically communicate the pressure chamber with a port in the pressure vessel part 3 into which a connection 63*a* for a weft insertion nozzle is secured.

Referring to FIGS. 9 and 11, the means for controlling the supply of medium from the pressure chamber into the port in the stator part 3 is in the form of a pair of segmented ring-shaped control elements 78*a*, 78*b*. Each of these elements 78*a*, 78*b* is adjustably mounted in the stator part 3 within an annular groove 121 and has a pin 54 secured thereto which projects via a cut-out 53 in the pressure vessel part 3.

As shown in FIG. 11, the annular groove 121 is aligned with the port 15*a* and one end of each control element 78*a*, 78*b* is aligned with the port 15*a* for circumferential movement relative thereto. As above, by adjusting the control elements 78*a*, 78*b* via the pins 54, the beginning, end, and/or duration of blowing of an air stream through the port 15*a* to the connection 63*a* can be varied.

Referring to FIG. 9, additional distributor and control units 10 can be disposed along the hollow shaft 8, for example to the left and right.

Figure 12:
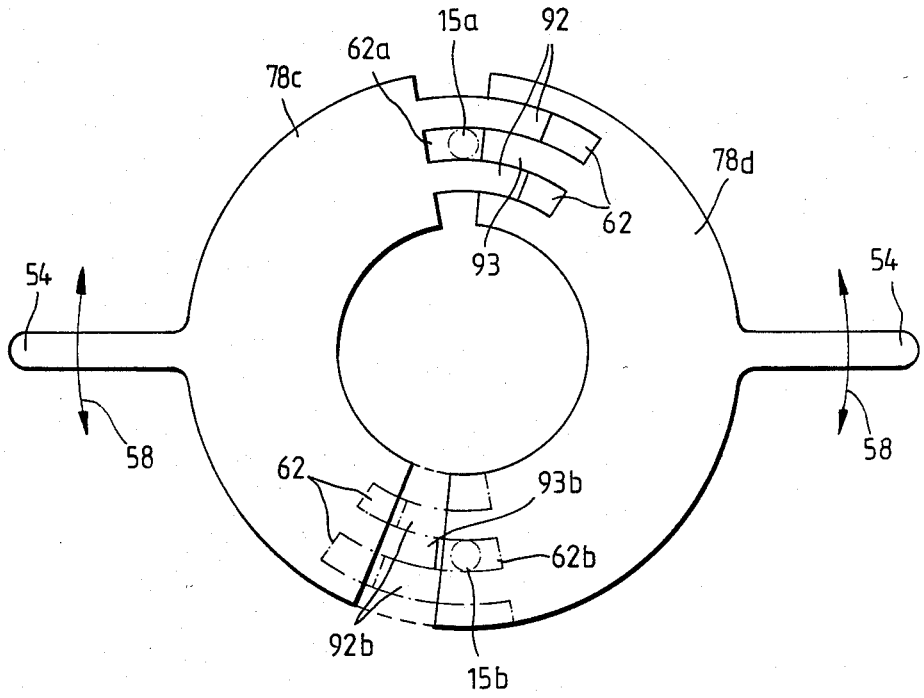
FIG. 12 illustrates a modified control element according to the invention.

Referring to FIG. 12, instead of using segmented ring-shaped control elements, use may be made of half-disc control elements 78*c*, 78*d*. As shown, these elements 78*c*, 78*d* have interfitting teeth 92, 93 which interengage in the manner of combs. As above, the teeth 92, 93 form slots 62, 62*a* which can be aligned with one or more ports 15*a* in a pressure vessel. Additonal teeth 92*b*, 93*b* as indicated in dash-dot lines in the bottom of FIG. 12 may also be provided to form a slot 62*b* which communicates with a port 15*b* in the vessel.

The half disc control elements 78*c*, 78*b* may be mounted in the stator part 3 shown in FIG. 11 by enlarging the annular groove 121.

The invention thus provides an air distributor and control unit which can be used for adjusting the flow of a pressure medium such as air into a nozzle of a jet insertion weaving macine. In the embodiments described, a single unit can be used for a plurality of nozzles or a sequential set of units can be arranged on a common shaft for regulating the flow through respective nozzles.

What is claimed is:

1. An air distributor and control unit for at least one nozzle of a jet insertion weaving machine, said unit comprising:

a stator having a port for communication with the nozzle;

a chamber to receive a pressurized flowable medium;

a rotor rotatably mounted within said stator and having an opening to periodically communicate said chamber with said port; and means adjustably mounted between said rotor and said stator to adjust the time of communication between said chamber and said port during rotation of said rotor for controlling the supply of medium from said chamber through said port.

2. A unit as set forth in claim 1 wherein said stator is a drum type pressure vessel having a plurality of ports, said rotor is a cylindrical control slide, said opening is a slot in said slide and said means is at least one shell type member adjustably mounted between said slide and said vessel to adjust the time of communication between said chamber and each respective port during rotation of said rotor.

3. A unit as set forth in claim 2 wherein said means includes a pair of said shell type members in diametrically opposed relation about said rotor.

4. A unit as set forth in claim 3 wherein said members have interfitting projections with at least one of said projections being aligned with a respective port.

5. A unit as set forth in claim 4 which further comprises actuation elements secured to said members and projecting through said pressure vessel for displacement of said members.

6. A unit as set forth in claim 3 wherein said vessel has an elongated manifold communicating with said port on a surface facing said members.

7. A unit as set forth in claim 1 wherein said stator is a fixed drum, said rotor includes a disc and said means is a disc-shaped control element adjustably mounted between said disc and said port to control the supply of medium from said chamber through at least said port.

8. A unit as set forth in claim 1 wherein said stator defines said chamber, said rotor includes a disc facing said chamber and said means is a disc-shaped control element adjustably mounted between said disc and at least one of said ports, said control element having a plurality of circumferentially disposed cut-outs of disparate circumferential size aligned with said port in said stator.

9. A unit as set forth in claim 1 wherein said stator is a ring, said rotor is a hollow shaft with said chamber therein, and said means is a bushing concentrically between said rotor and said stator, said bushing having a plurality of circumferentially disposed cut-outs of disparate circumferential size aligned with said port in said ring.

10. A unit as set forth in claim 1 wherein said stator defines said chamber, said rotor includes a disc facing said chamber and said means includes a segmented ring-shaped control element adjustably mounted on said stator between said disc and said port, said element having an end aligned with said port for communication between said chamber and said port during rotation of said rotor.

11. An air distributor and control unit for a plurality of nozzles of a jet insertion weaving machine, said unit comprising a stator having a plurality of ports for respective communication with the nozzles;

a chamber to receive a pressurized flowable medium;

a rotor rotatably mounted within said stator and having an opening to sequentially communicate said chamber with said ports; and means adjustably mounted between said rotor and said stator for controlling the supply of medium from said chamber through said ports.

12. A unit as set forth in claim 11 wherein said means is adjustably mounted to adjust the time of communication between said chamber and each respective port during rotation of said rotor.

13. A unit as set forth in claim 12 wherein said stator is a drum type pressure vessel, said rotor is a cylindrical control slide, said opening is a slot in said slide and said means is at least one shell type member adjustably mounted between said slide and said vessel and having a plurality of comb-like projections aligned with said ports.

14. An air distributor and control unit for a plurality of nozzles of a jet insertion weaving machine, said unit comprising a drum type pressure vessel having a plurality of ports for communication with the nozzles;

a chamber in said vessel to receive a pressurized flowable medium;

a cylindrical control slide rotatably mounted within said vessel and having a slot to periodically communicate said chamber with said ports; and at least one shell type member adjustably mounted between said slide and said vessel to adjust the time of communication between said chamber and each respective port through said slot during rotation of said slide for controlling the supply of medium from said chamber through each said port.

15. A unit as set forth in claim 14 wherein said means includes a pair of said shell type members in diametrically opposed relation about said rotor.

16. A unit as set forth in claim 15 wherein said members have interfitting projections with at least one of said projections being aligned with a respective port.

17. An air distributor and control unit for a plurality of nozzles of a jet insertion weaving machine, said unit comprising a stator having a plurality of ports for respective communication with the nozzles;

a chamber to receive a pressurized flowable medium;

a rotor rotatably mounted within said stator and having an opening to sequentially communicate said chamber with said ports; and means adjustably mounted between said rotor and said stator to adjust the time of communication between said chamber and each respective port during rotation of said rotor for controlling the supply of medium from said chamber through said ports.

* * * * *